US011266202B2

(12) United States Patent
Farris et al.

(10) Patent No.: US 11,266,202 B2
(45) **Date of Patent: *Mar. 8, 2022**

(54) FOOTWEAR SOLE STRUCTURE WITH NONLINEAR BENDING STIFFNESS

(71) Applicant: NIKE, Inc., Beaverton, OR (US)

(72) Inventors: Bryan N. Farris, North Plains, OR (US); Austin Orand, Portland, OR (US); Alison Sheets-Singer, Portland, OR (US); Aaron B. Weast, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 195 days.

This patent is subject to a terminal disclaimer.

(21) Appl. No.: 16/574,681

(22) Filed: Sep. 18, 2019

(65) Prior Publication Data

US 2020/0008519 A1 Jan. 9, 2020

Related U.S. Application Data

(63) Continuation of application No. 15/266,657, filed on Sep. 15, 2016, now Pat. No. 10,448,701.

(Continued)

(51) Int. Cl.

| | |
|---|---|
| ***A43B 13/14*** | (2006.01) |
| ***A43B 13/12*** | (2006.01) |
| ***A43B 13/04*** | (2006.01) |
| ***A43B 13/18*** | (2006.01) |
| ***A43B 17/02*** | (2006.01) |
| ***A43B 13/22*** | (2006.01) |
| ***A43B 23/02*** | (2006.01) |

(Continued)

(52) U.S. Cl.

CPC ..... *A43B 13/141* (2013.01); *A43B 13/04* (2013.01); *A43B 13/12* (2013.01); *A43B 13/127* (2013.01); *A43B 13/181* (2013.01); *A43B 13/186* (2013.01); *A43B 13/188* (2013.01); *A43B 13/223* (2013.01); *A43B 17/02* (2013.01); *A43B 23/026* (2013.01); *A43B 23/028* (2013.01); *A43C 15/16* (2013.01); *A43B 5/02* (2013.01)

(58) Field of Classification Search

CPC ... A43B 13/181; A43B 13/141; A43B 13/223; A43B 13/26; A43B 13/12; A43B 13/188; A43B 17/02; A43B 5/002; A43B 5/06

USPC ..... 36/28

See application file for complete search history.

(56) References Cited

U.S. PATENT DOCUMENTS

| | | | | |
|---|---|---|---|---|
| 2,211,057 | A | 8/1940 | Duckoff | |
| 2,640,283 | A * | 6/1953 | McCord | A43B 5/00 36/25 R |

(Continued)

*Primary Examiner* — Timothy K Trieu

(74) *Attorney, Agent, or Firm* — Quinn IP Law

(57) ABSTRACT

A sole structure for an article of footwear comprises a sole plate that has a forefoot region, and a stiffness enhancing assembly disposed in the forefoot region of the sole plate. The stiffness enhancing assembly further comprises a compression member disposed at a foot-facing side of the sole plate, and a tensile member disposed at an opposite side of the sole plate from the compression member. The tensile member is spaced apart from the compression member by a first distance in a first portion of a flexion range during dorsiflexion of the sole structure, and interferes with the compression member during a second portion of the flexion range that includes flex angles greater than in the first portion of the flexion range.

20 Claims, 7 Drawing Sheets

Related U.S. Application Data

(60) Provisional application No. 62/220,678, filed on Sep. 18, 2015, provisional application No. 62/220,758, filed on Sep. 18, 2015, provisional application No. 62/220,638, filed on Sep. 18, 2015, provisional application No. 62/220,633, filed on Sep. 18, 2015.

(51) Int. Cl.
*A43C 15/16* (2006.01)
*A43B 5/02* (2006.01)

(56) References Cited

U.S. PATENT DOCUMENTS

| | | | | |
|---|---|---|---|---|
| 3,039,207 | A * | 6/1962 | Lincors | A43B 13/18 36/58.5 |
| 10,653,205 | B2 * | 5/2020 | Orand | A43B 13/141 |
| 2004/0250446 | A1 | 12/2004 | Greene et al. | |
| 2005/0000115 | A1 * | 1/2005 | Kimura | A43B 7/1445 36/25 R |
| 2014/0013624 | A1 | 1/2014 | Stockbridge et al. | |

* cited by examiner

FOOTWEAR SOLE STRUCTURE WITH NONLINEAR BENDING STIFFNESS

CROSS-REFERENCE TO RELATED APPLICATIONS

This application claims the benefit of U.S. patent application Ser. No. 15/266,657 filed Sep. 15, 2016, which claims the benefit of priority to U.S. Provisional Application No. 62/220,633 filed Sep. 18, 2015, U.S. Provisional Application No. 62/220,758 filed Sep. 18, 2015, U.S. Provisional Application No. 62/220,638 filed Sep. 18, 2015, and U.S. Provisional Application No. 62/220,678 filed Sep. 18, 2015, all of which are incorporated herein in their entirety.

TECHNICAL FIELD

The present teachings generally include a sole structure for an article of footwear.

BACKGROUND

Footwear typically includes a sole structure configured to be located under a wearer's foot to space the foot away from the ground. Sole assemblies in athletic footwear are typically configured to provide cushioning, motion control, and/or resiliency.

DESCRIPTION

Figure 1:
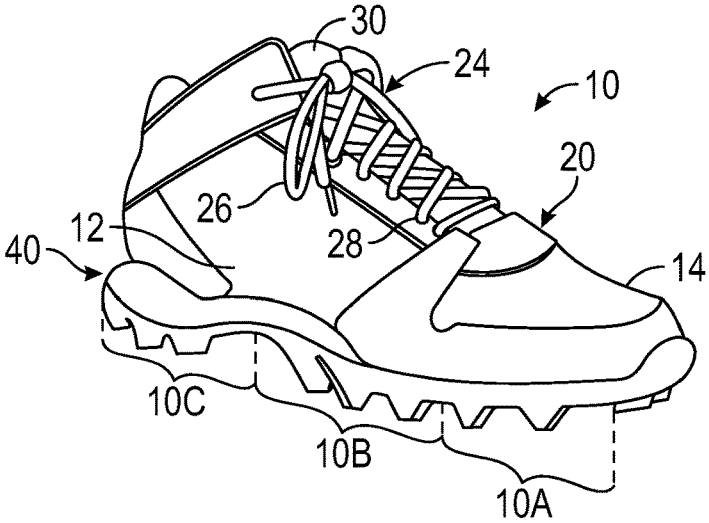
FIG. 1 is a lateral side perspective view of an article of footwear according to an exemplary embodiment of the present disclosure.

The present disclosure generally provides a sole structure for footwear having a forefoot region, a heel region, and a midfoot region between the forefoot region and the heel region. The heel region may also be referred to as a rearfoot region. The forefoot region, the heel region, and the midfoot region are also referred to as the forefoot portion, the heel portion, and the midfoot portion, respectively. The footwear according to the present disclosure may be athletic footwear, such as football, soccer, or cross-training shoes, or the footwear may be for other activities, such as but not limited to other athletic activities. Embodiments of the footwear generally include an upper, and a sole structure coupled to the upper.

More specifically, a sole structure for an article of footwear comprises a sole plate that has a forefoot region. A stiffness enhancing assembly is disposed in the forefoot region of the sole plate. The stiffness enhancing assembly further comprises a compression member disposed at a foot-facing side of the sole plate, and a tensile member disposed at an opposite side of the sole plate from the compression member. The tensile member is spaced apart from the compression member by a first distance in a first portion of a flexion range during dorsiflexion of the sole structure, and interferes with the compression member during a second portion of the flexion range that includes flex angles greater than in the first portion of the flexion range. The first distance may progressively decreases throughout the first portion of the flexion range.

The plate may extend between the forefoot region and the heel region, or between the forefoot region and the midfoot region. The plate may be part of either of a midsole, or an insole, or an outsole of the sole structure, or can comprise a combination of any two or more of the midsole, the insole, and the outsole. As used in this description and the accompanying claims, the phrase "bend stiffness" generally means a resistance to flexion of the sole exhibited by a material, structure, assembly of two or more components or a combination thereof, according to the disclosed embodiments and their equivalents.

In an embodiment, the first portion of the flexion range includes flex angles of the sole structure less than a first predetermined flex angle, and the second portion of the flexion range includes flex angles of the sole structure greater than or equal to the first predetermined flex angle. The sole structure has a change in bending stiffness at the first predetermined flex angle. For example, the sole structure has a first bending stiffness in the first portion of the flexion range, and a second bending stiffness greater than the first bending stiffness in the second portion of the flexion range. In a nonlimiting example, the first predetermined flex angle may be an angle selected from the range of angles extending from 35 degrees to 65 degrees.

In an embodiment, the tensile member includes a posterior portion, an anterior portion, and a body portion disposed between the posterior portion and the body portion. The tensile member is spaced apart from the body portion of the compression member by the first distance. The body portion of the tensile member remains spaced apart from the compression member throughout a first portion of the flexion range, and the body portion of the tensile member is in contact with the compression member throughout a second portion of the flexion range. A width of the body portion of the tensile member may be less than a width of the compression member.

In an embodiment, the tensile member bows outwardly away from the compression member when the sole plate is in a relaxed, unflexed state. In another embodiment, the tensile member is planar and parallel with the compression member when the sole plate is in a relaxed, unflexed state. The sole structure may include an outsole, and the plate may be disposed on, joined to or integrally formed of unitary construction with the outsole.

The plate may further comprise a plurality of cleats extending from a ground-facing surface of the plate. In some embodiments, the compression member and the tensile member are comprised either of nylon or thermoplastic polyurethane. The plate and the stiffness enhancing assembly may be integrally formed of unitary construction. Alternatively, the plate may comprise two layers bonded together posterior to and anterior to the stiffness enhancing assembly. A first of the two layers may include the compression member, and a second of the two layers may include the tensile member.

In an embodiment, a sole structure for an article of footwear comprises a sole plate that has a forefoot region, and a stiffness enhancing assembly disposed in the forefoot region of the sole plate. The stiffness enhancing assembly comprises a compression member disposed at a foot-facing side of the sole plate, and a bowed tensile member disposed at an opposite side of the sole plate from the compression member. The bowed tensile member has an anterior portion, a body portion, and a posterior portion arranged longitudinally and descending below the compression member such that the body portion is spaced apart from the compression member by a gap when the sole structure is in an unflexed, relaxed state. Dorsiflexion of the sole structure causes the compression member and the tensile member to progressively close the gap as the sole structure flexes through a first portion of a flexion range until the compression member and the tensile member contact one another when the sole structure is dorsiflexed at a first predetermined flex angle, such that the sole structure has a change in bending stiffness at the first predetermined flex angle. The body portion of the tensile member may remain in contact with the compression member throughout a second portion of the flexion range that includes flex angles greater than flex angles in the first portion of the flexion range. The plate may comprise two layers bonded together posterior to and anterior to the stiffness enhancing assembly, a first of the two layers including the compression member, and a second of the two layers including the tensile member. Alternatively, the plate and the stiffness enhancing assembly may be integrally formed of unitary construction. A width of the body portion of the tensile member may be less than a width of the compression member.

The above features and advantages and other features and advantages of the present teachings are readily apparent from the following detailed description of the modes for carrying out the present teachings when taken in connection with the accompanying drawings.

"A," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

The term "longitudinal," as used herein, refers to a direction extending along a length of the sole structure, e.g., from a forefoot portion to a heel portion of the sole structure. The term "transverse," as used herein, refers to a direction extending along a width of the sole structure, e.g., from a lateral side to a medial side of the sole structure. The term "forward" is used to refer to the general direction from the heel portion toward the forefoot portion, and the term "rearward" is used to refer to the opposite direction, i.e., the direction from the forefoot portion toward the heel portion. The term "anterior" is used to refer to a front or forward component or portion of a component. The term "posterior" is used to refer to a rear or rearward component of portion of a component. Those having ordinary skill in the art will recognize that terms such as "above," "below," "upward," "downward," "top," "bottom," etc., may be used descriptively relative to the figures, without representing limitations on the scope of the invention, as defined by the claims.

Figure 2:
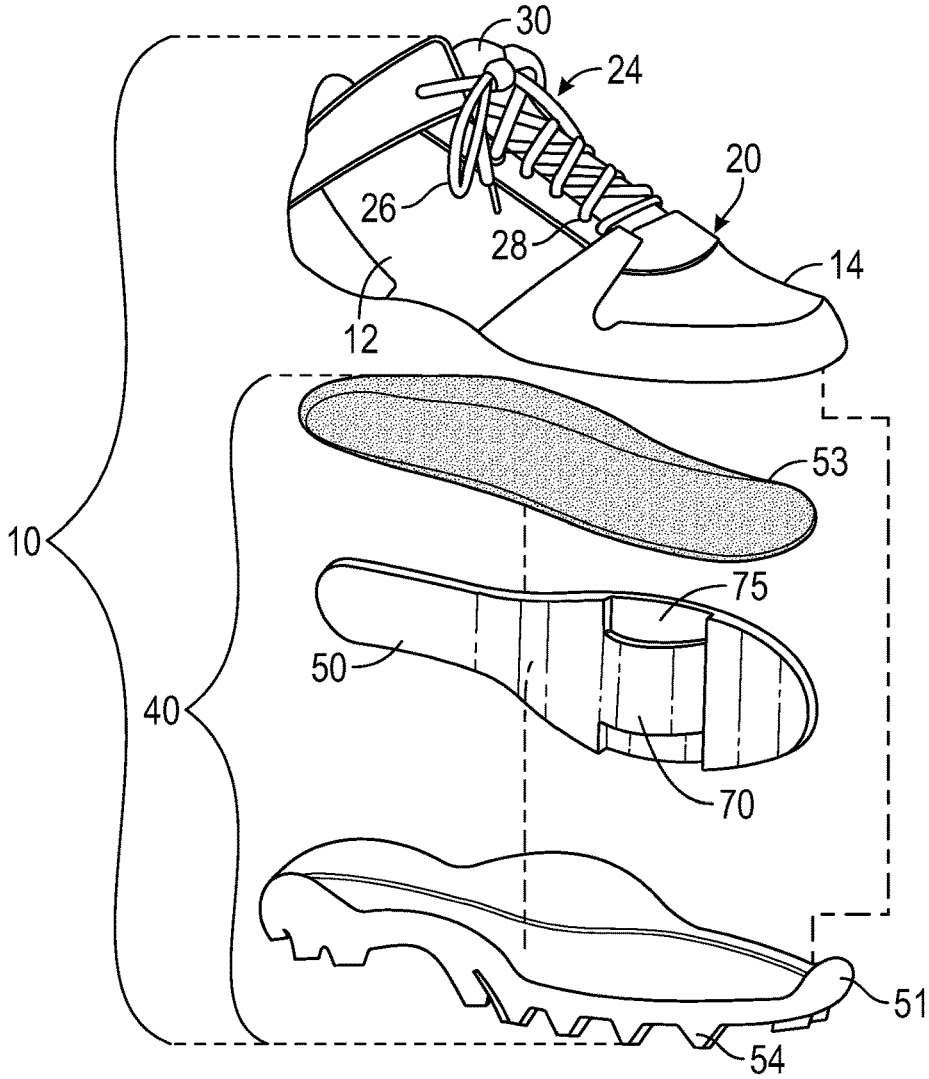
FIG. 2 is an exploded view of the footwear of FIG. 1.
Figure 3:
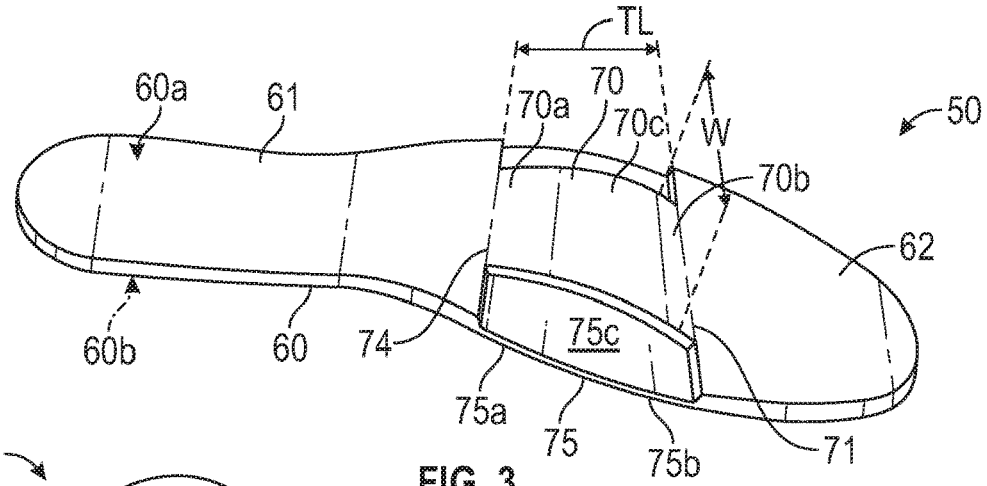
FIG. 3 is a medial side perspective view of the ground-facing surface of a sole plate according to an exemplary embodiment of the present disclosure.

An exemplary embodiment of an article of footwear 10 according to the present disclosure is shown in FIGS. 1 and 2. In this exemplary embodiment, the footwear 10 is a cleated shoe and includes an upper 20 and a supporting sole structure 40 (referred to herein as either "sole structure", "sole assembly", or "sole") coupled to a lower area of the upper 20. The upper may be coupled with the sole using any of one or more conventional techniques, such that the sole structure supports a wearer's foot during use. For descriptive convenience, footwear 10 may be considered to be divided into the three general regions; the forefoot region 10A, the midfoot region 10B, and the heel region 10C. The forefoot region 10A generally includes portions of footwear 10 positionally corresponding with forward portions of a user's foot during use, including the toes and the joints connecting the metatarsal bones with the phalangeal bones (interchangeably referred to as the "metatarsal-phalangeal joint", "metatarsal-phalangeal joints", or "MPJ" herein). The midfoot region 10B extends between the forefoot region 10A and the heel region 10C, and generally includes portions of footwear 10 positionally corresponding with middle portions of a user's foot during use, including the foot's arch area. The heel region 10C is disposed rearwardly from the midfoot region 10B, and generally includes portions of footwear 10 corresponding with rear portions of a user's foot, including the heel and calcaneus bone.

Footwear 10 also includes a lateral side 12 and a medial side 14, which correspond with opposite sides of the footwear 10 and extend through each of regions 10A-10C. The lateral side 12 corresponds with an outside area of the foot, that is, the portion of a foot that faces away from the other foot. The medial side 14 corresponds with an inside area of the foot, that is, the portion of a foot that faces toward the other foot. Regions 10A-10C and sides 12 and 14 are not intended to demarcate precise areas of the footwear 10, but rather are intended to represent general areas of the footwear 10 to aid in the following discussion. In addition to footwear 10, the regions 10A-10C and sides 12 and 14 may also be applied to portions of the footwear, including but not limited to the upper 20, the sole structure 40, and individual elements thereof.

The upper 20 can be configured in a similar manner, with regard to dimensions, shape, and materials, for example, as any conventional upper suitable to support the receive and retain a foot of a wearer; e.g., an athlete. The upper 20 forms a void (also referred to herein as a foot-receiving cavity) configured to accommodate insertion of a user's foot, and to effectively secure the foot within the footwear 10 relative to an upper surface of the sole, or to otherwise unite the foot and the footwear 10. In the embodiment shown, the upper 20 includes an opening that provides a foot with access to the void, so that the foot may be inserted into and withdrawn from the upper 20 through the opening. The upper 20 typically further includes one or more components suitable to further secure a user's foot proximate the sole, such as but not limited to a lace 26, a plurality of lace-receiving elements 28, and a tongue 30, as will be recognized by those skilled in the art.

The upper 20 can be formed of one or more layers, including for example one or more of a weather-resistant, a wear-resistant outer layer, a cushioning layer, and a lining layer. Although the above described configuration for the upper 20 provides an example of an upper that may be used in connection with embodiments of a sole plate 50 (or simply "plate" or "plate member" herein), a variety of other conventional or nonconventional configurations for the upper may also be utilized. Accordingly, the features of upper 20 may vary considerably. Further, a removable cushion member 53, shown in FIG. 2, may optionally be inserted into the upper 20 to provide additional wearer comfort, and in some embodiments, the cushion member 53 may comprise the insole. In other embodiments, an insole may be securely coupled to a portion of a foot-facing surface of the midsole.

The sole structure 40 of the footwear 10 extends between the foot and the ground to, for example, attenuate ground reaction forces to cushion the foot, provide traction, enhance stability, and influence the motions of the foot. When the sole structure 40 is coupled to the upper 20, the sole and upper can flex in cooperation with each other.

Referring to FIG. 2, the sole structure 40 may be a unitary structure with a single layer that includes a ground-contacting element of the footwear, or the sole structure 40 may include multiple layers. For example, a non-limiting exemplary multiple layer sole may include three layers, referred to as an insole, a midsole, and an outsole for descriptive convenience herein. The insole 53 may comprise a thin, comfort-enhancing member located adjacent to the foot. The midsole forms the middle layer of the sole structure between the insole and the outsole, and serves a variety of purposes that may include controlling foot motions and shielding the foot from excessive ground reaction forces. In one or more of the disclosed embodiments, the midsole comprises a sole plate 50 including a stiffness enhancing assembly, as shown in FIG. 2. The outsole 51 comprises a ground-contacting element of the footwear, and is usually fashioned from a durable, wear resistant material. Examples of such materials can include, but are not limited to, nylon, thermoplastic polyurethane, carbon fiber, and others, as would be recognized by an ordinarily skilled artisan. Ground contacting elements of the outsole 51 may include texturing or other traction features or elements, such as cleats 54, configured to improve traction with one or more types of ground surfaces (e.g., natural grass, artificial turf, asphalt pavement, dirt, etc.). The outsole 51 may also be referred to as a plate.

Although the exemplary embodiments herein describe and depict the sole plate 50 and its stiffness enhancing features as a midsole, or a portion of a midsole, the embodiments include likewise configured sole plate embodiments disposed either as an outsole or an insole, or as a portion of an outsole or of an insole. Likewise, the embodiments encompass embodiments wherein the sole plate comprises a combination of an insole and a midsole, a combination of a midsole and an outsole, or as a combination of an insole, a midsole, and an outsole. When configured as an outsole or outsole portion, one or more embodiments of the sole plate include ground contacting element disposed at, attached to, or projecting from its lower, ground-facing side. Various ones of the plates described herein may be an insole plate, also referred to as an insole, an inner board plate, inner board, insole board, or lasting board. Still further, the plates could be a midsole plate or a unisole plate, or may be one of, or a unitary combination of any two or more of, an outsole, a midsole, and/or an insole (also referred to as an inner board plate). Optionally, an insole plate, or other layers may overlay the plates between the plates and the foot.

It is noted that when in the unflexed position, the forefoot region of the plate may be generally flat, or alternatively, the forefoot region of the plate may have a preformed curvature. A plate can be but is not necessarily flat and need not be a single component but instead can be multiple interconnected components. For example, a plate may be pre-formed with some amount of curvature and variations in thickness when molded or otherwise formed in order to provide a shaped footbed and/or increased thickness for reinforcement in desired areas. For example, the plate could have a curved or contoured geometry that may be similar to the lower contours of the foot.

Referring to FIGS. 3-9, the plate 50 includes a base 60 and a stiffness enhancing assembly 72 configured to correspond to the forefoot region of an article of footwear, as shown in FIGS. 6-9. The plate 50 is partially inverted in FIG. 3. The base 60 has a lower surface 60*a* that generally faces away from the upper, and an upper surface 60*b* that faces toward the upper 20. Additionally, an exemplary embodiment of the base 60 comprises a posterior base portion 61 and an anterior base portion 62, with the stiffness enhancing assembly 72 being disposed between the posterior and anterior base portions. The posterior base portion 61 can extend from the heel region 10C to the midfoot region 10B, or from the heel region 10C to the forefoot region 10A, or from the midfoot region 10B to the forefoot region 10A, according to alternative embodiments. The anterior base portion 62 generally extends within the forefoot region, and in a typical but non-exclusive embodiment, extends forwardly to the anterior extent of the sole structure 40.

The stiffness enhancing assembly 72 generally comprises a tensile member 70 disposed proximate the lower surface 60*a* of the base 60, and a compression member 75 disposed proximate the upper surface 60*b* of the base 60. In a typical embodiment, the tensile member 70 includes a posterior portion 70*a*, an anterior portion 70*b*, and a body portion 70*c* disposed between the posterior and anterior portions, 70*a* and 70*b* respectively. The tensile member 70 has a tensile-member anterior extent 71, a tensile-member posterior extent 74 opposite the tensile-member anterior extent 71, and a tensile-member length TL extending from the tensile-member anterior extent 71 to the tensile-member posterior extent 74. Likewise, the compression member 75 also typically includes a posterior portion 75*a*, an anterior portion 75*b*, and a body portion 75*c* disposed between the anterior and posterior portions, 75*a* and 75*b* respectively. The compression member 75 has a compression-member anterior extent 76, a compression-member posterior extent 77 opposite the compression-member posterior extent 76, and a compression-member length CL extending from the compression-member anterior extent 76 to the compression-member posterior extent 77. The anterior portions of each of the tensile member and the compression member typically are coupled with the anterior base portion 62, such that the anterior base portion extends forwardly from the stiffness enhancing assembly 72, as shown in FIGS. 3-9. Similarly, the posterior portions of each of the tensile member and the compression member are typically coupled with the posterior base portion 61, such that the posterior base portion extends rearwardly from the stiffness enhancing assembly. The tensile member 70 is spaced apart from the compression member 75 by a gap G when the sole structure 40 is in an unflexed position. The gap G has a gap anterior extent 78, a gap posterior extent 79 opposite the gap anterior extent 78, and a gap length GL extending from the gap anterior extent 78 to the gap posterior extent 79.

Figure 5:
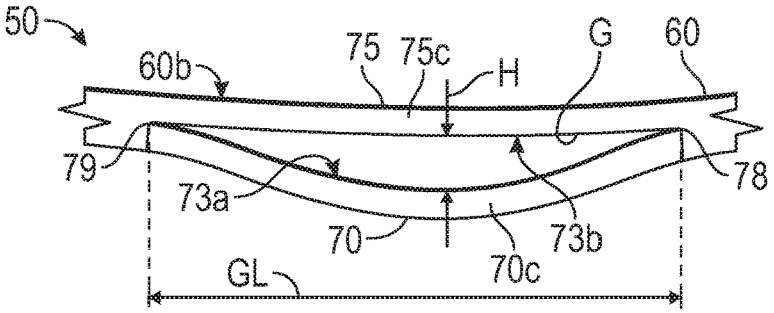
FIG. 5 is a fragmentary side elevation view of a portion of the sole plate of FIG. 3.
Figure 6:
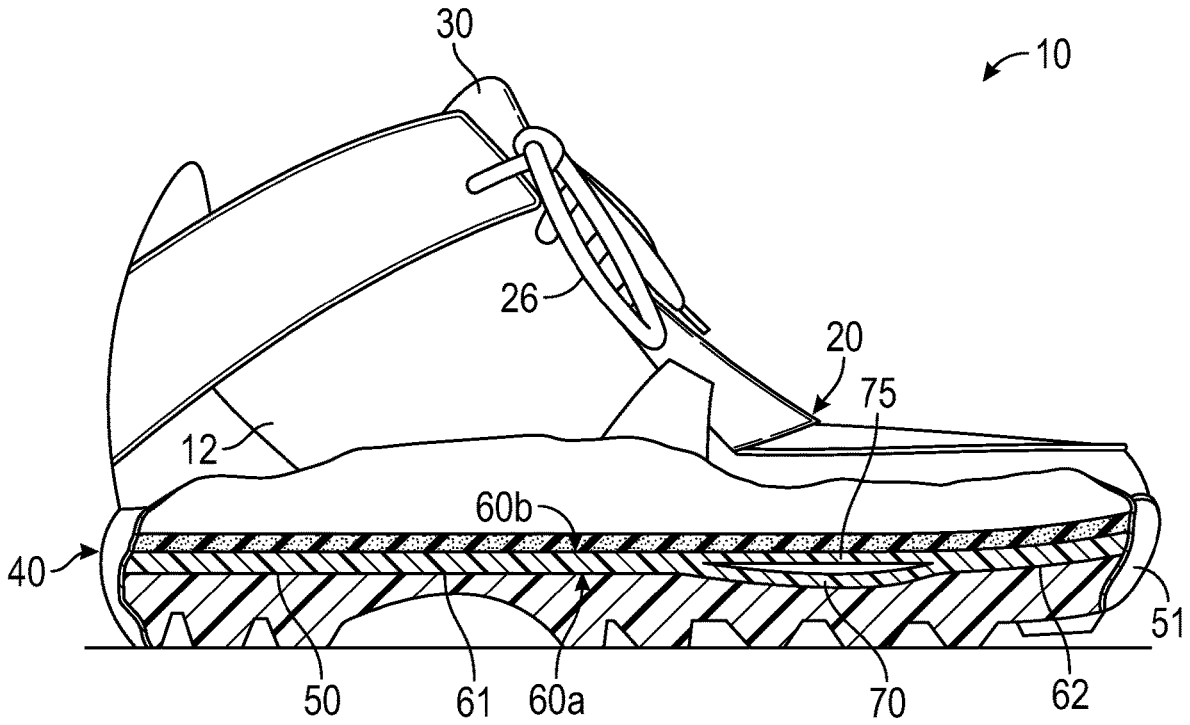
FIG. 6 is a lateral side elevation view of the footwear of FIG. 1 with the sole plate of FIG. 3 in an unflexed, relaxed position, including a partial sectional view of the stiffness enhancing assembly, according to another exemplary embodiment.
Figure 7:
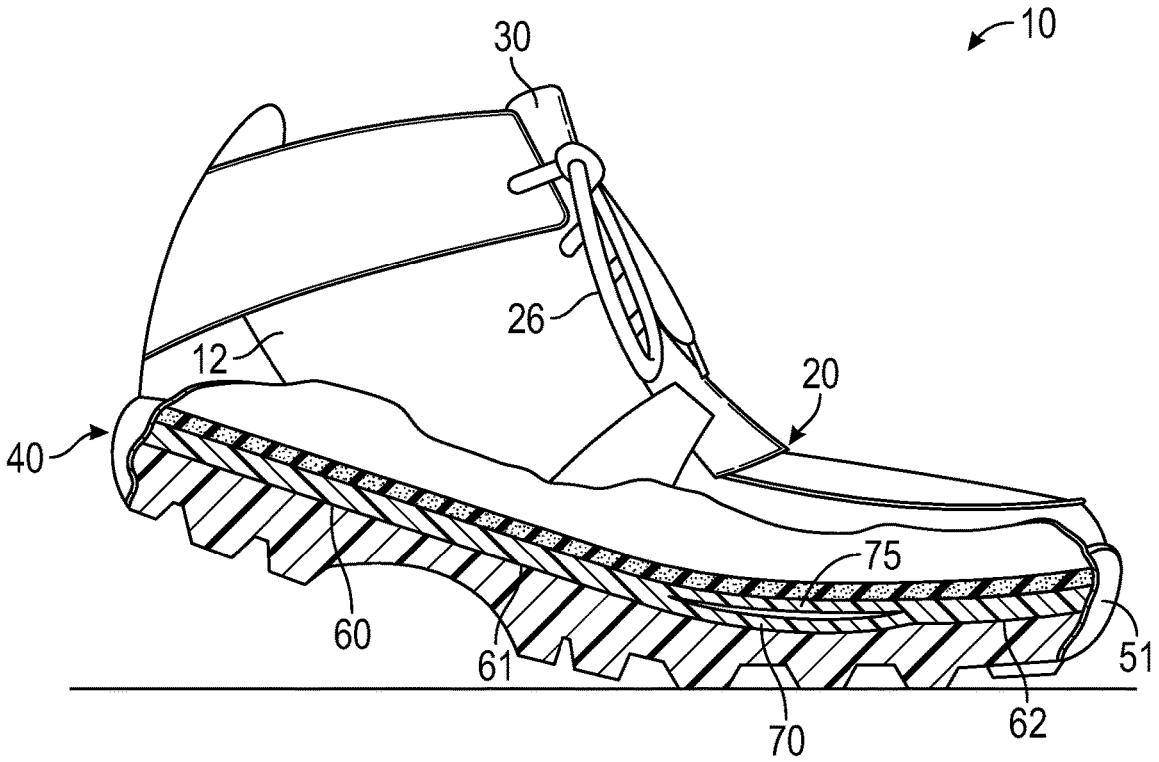
FIG. 7 is a lateral side elevation view of the footwear of FIG. 6 with the sole plate in a partially flexed condition.
Figure 8:
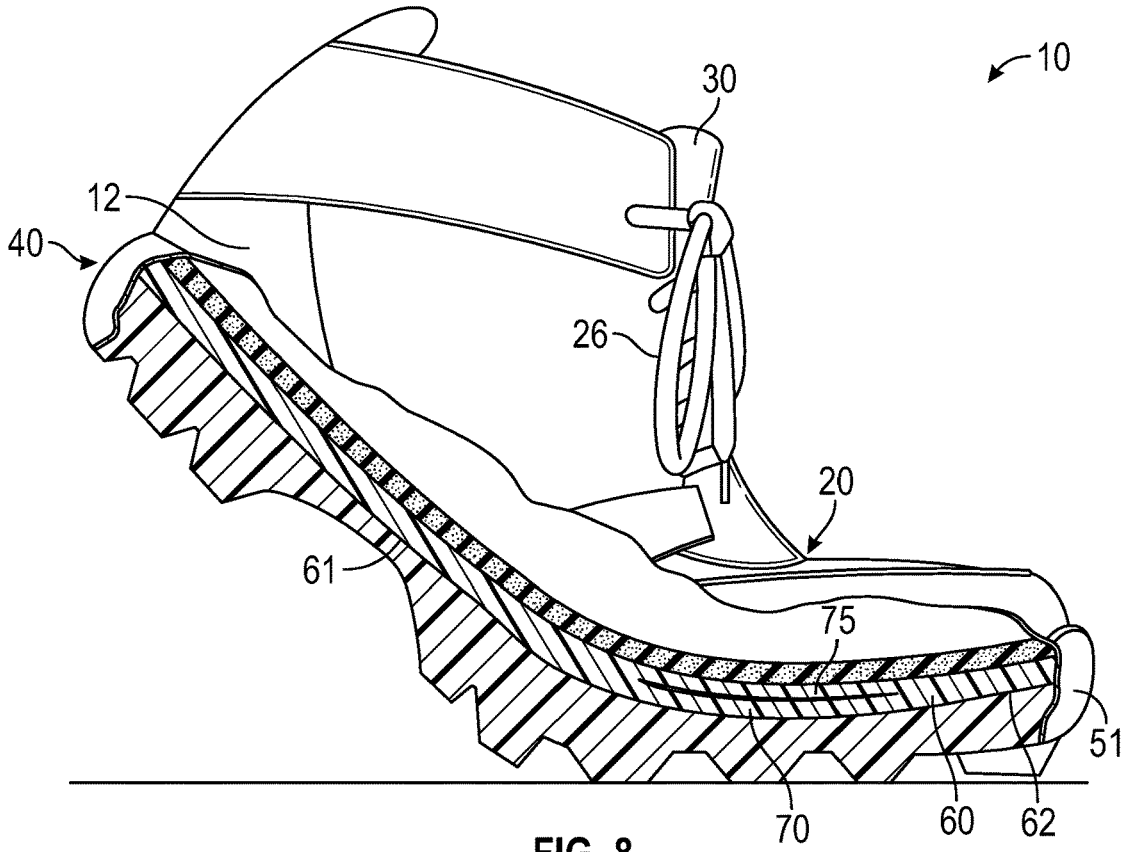
FIG. 8 is a lateral side elevation view of the footwear of FIG. 7 with the sole plate further flexed nearly to an end of a first portion of its flexion range.
Figure 9:
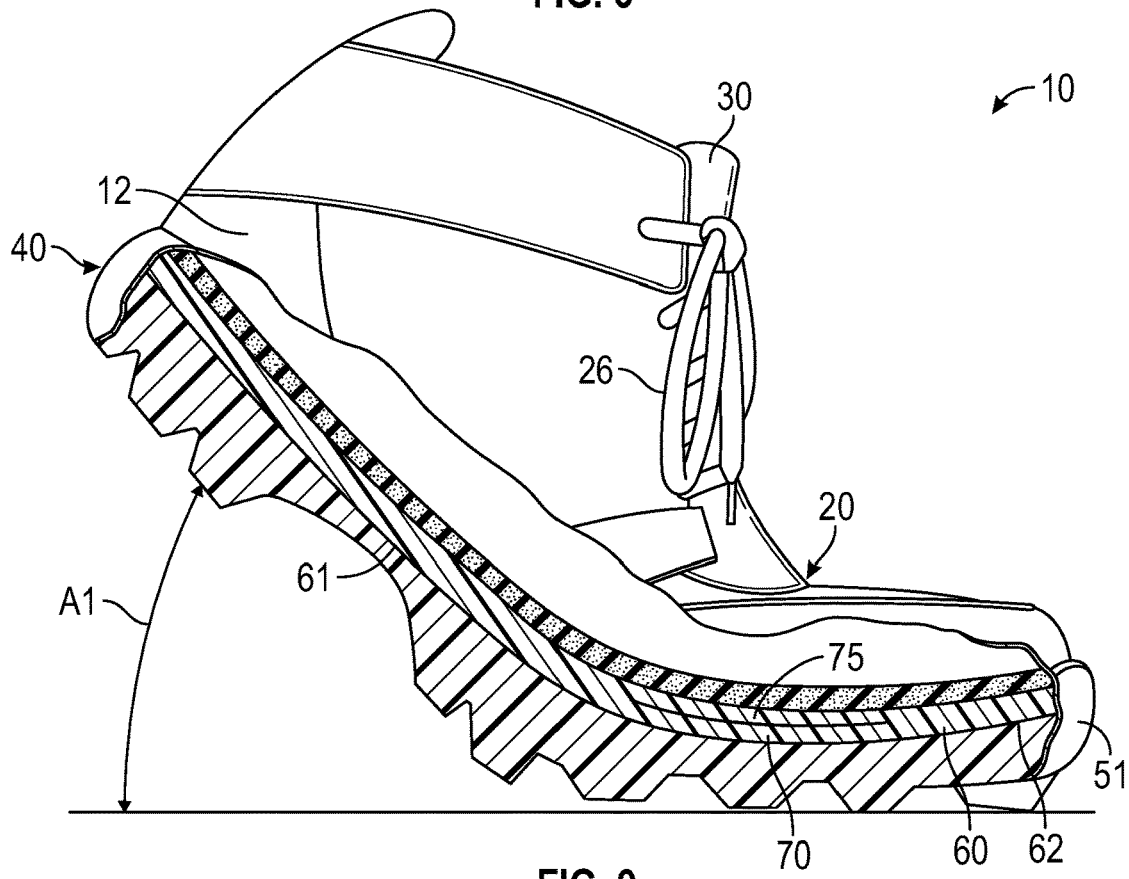
FIG. 9 is a lateral side elevation view of the footwear of FIG. 8 with the sole plate flexed to a first predetermined flex angle.
Figure 10:
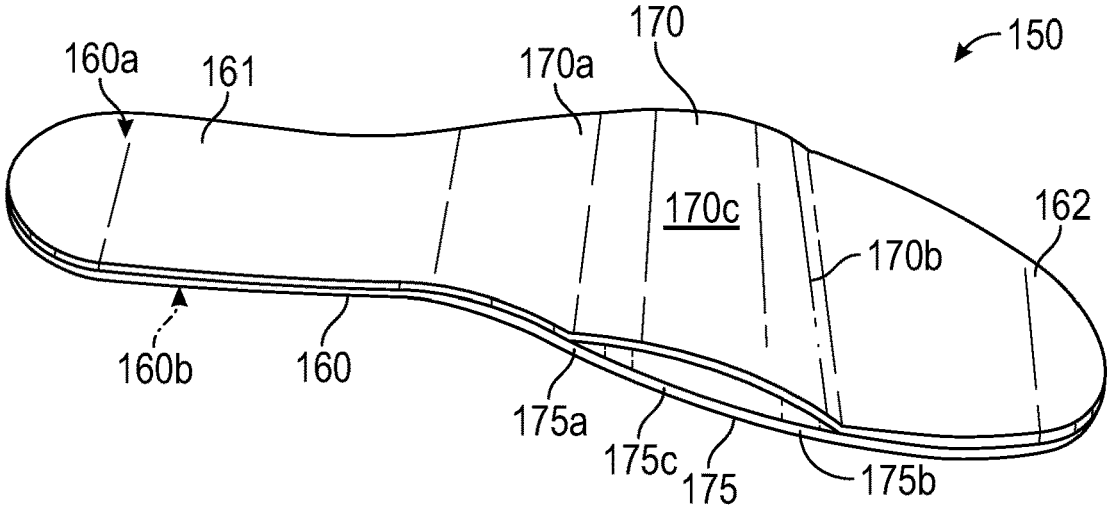
FIG. 10 is a medial side perspective view of the ground-facing surface of a sole plate according to another embodiment of the present disclosure.

When the plate 50 is in an unflexed position, as seen in FIGS. 5 and 6, the body portion 70*c* of the tensile member 70 is spaced from the corresponding body portion 75*c* of the compression member 75 by a distance "H", seen in FIG. 5. During use, however, dorsiflexion of the plate with bending occurring within the portion of the plate wherein the stiffness enhancing assembly 72 resides, causes the distance "H" to progressively decrease until a portion of an upper surface 73*a* of the tensile member 70 contacts a portion of a lower surface 73*b* of the compression member 75. Such contact occurs at an extent of dorsiflexion corresponding to a predetermined flex angle A1, as shown in FIG. 9. The predetermined flex angle A1 is defined as the angle formed at the intersection between a first axis generally extending along a longitudinal midline at the ground-facing surface of the posterior base portion 61 and a second axis generally extending along a longitudinal midline at the ground-facing surface of the anterior base portion 61. The intersection of the first and second axes will typically be approximately centered both longitudinally and transversely below the stiffness enhancing assembly.

For the purposes of the present disclosure, the forefoot region of plate 50 is flexible, being capable of bending throughout a flexion range. This flexion range is conceptually divided into two portions. A first portion of the flexion range (also referred to as a first range of flexion) includes flex angles during dorsiflexion of the sole structure from zero (i.e., an unflexed, relaxed state of the of the plate 50, as seen in FIG. 6 for example, to any flex angle less than the first predetermined flex angle (defined as angle A1 when the corresponding facing surfaces of the body portion 70*c* of the tensile member 70 and the body portion 75*c* of the compression member 75 arrive into contact with one another, as seen in FIG. 9. A second portion of the flexion range begins as soon as the plate 50 is dorsiflexed to the first predetermined flex angle described above, and extends throughout greater flex angles with any further dorsiflexion of the plate 50 through progressively increasing angles of flexure greater than angle A1. Therefore, as used within this description, first contact between the tensile member 70 and the compression member 75 conceptually demarcates the first predetermined flex angle.

The numerical value of the first predetermined flex angle A1 is dependent upon a number of factors, notably but non-exclusively, the dimension of distance "H" separating the tensile member 70 from the compression member 75 proximate their respective and corresponding body portions, the respective lengths of each of the tensile member and the compression member, and the particular structure of the stiffness enhancing assembly according to alternative embodiments, as will be discussed further below.

In one exemplary embodiment, the first predetermined flex angle A1 is in the range of between about 30 degrees and about 60 degrees, with a typical value of about 55 degrees. In another exemplary embodiment, the first predetermined flex angle A1 is in the range of between about 15 degrees and about 30 degrees, with a typical value of about 25 degrees. In another example, the first predetermined flex angle A1 is in the range of between about 20 degrees and about 40 degrees, with a typical value of about 30 degrees. In particular, the first predetermined flex angle can be any one of 35°, 36°, 37°, 38°, 39°, 40°, 41°, 42°, 43 , 44°, 45°, 46°, 47°, 48°, 49°, 50°, 51°, 52°, 53°, 54°, 55°, 56°, 57°, 58°, 59°, 60°, 61°, 62°, 63°, 64°, or 65°. Generally, the specific flex angle or range of angles at which a change in the rate of increase in bending stiffness occurs is dependent upon the specific activity for which the article of footwear is designed.

As an ordinarily skilled artisan will recognize in view of the present disclosure, the sole plate 50 will bend in dorsiflexion in response to forces applied by corresponding bending of a user's foot at the Min during physical activity. Throughout the first portion of the flexion range FR1, the bending stiffness (defined as the change in moment as a function of the change in flex angle) will remain approximately the same as bending progresses through increasing angles of flexion. Because bending within the first portion of the flexion range FR1 is primarily governed by inherent material properties of the materials of the sole plate 50, a graph of torque (or moment) on the sole plate 50 versus angle of flexion (the slope of which is the bending stiffness) in the first portion of the flexion range FR1 will typically demonstrate a smoothly but relatively gradually inclining curve (referred to herein as a "linear" region with constant bending stiffness). At the boundary between the first and second portions of the range of flexion, however, structures of the sole plate 50, as described herein, such that additional material and mechanical properties exert a notable increase in resistance to further dorsiflexion. Therefore, a corresponding graph of torque versus angle of flexion (the slope of which is the bending stiffness) that also includes the second portion of the flexion range FR2 would show— beginning at an angle of flexion approximately corresponding to angle A1—a departure from the gradually and smoothly inclining curve characteristic of the first portion of the flexion range FR1. This departure is referred to herein as a "nonlinear" increase in bending stiffness, and would manifest as either or both of a stepwise increase in bending stiffness and/or a change in the rate of increase in the bending stiffness. The change in rate can be either abrupt, or it can manifest over a short range of increase in the bend angle (i.e., also referred to as the flex angle or angle of flexion) of the sole plate 50. In either case, a mathematical function describing a bending stiffness in the second portion of the flexion range FR2 will differ from a mathematical function describing bending stiffness in the first portion of the flexion range.

Functionally, when the plate 50 is dorsiflexed as shown sequentially in FIGS. 6-9, the distance "H" decreases as the adjacent facing surfaces of the compression member 75 and the tensile member 70 are drawn together and eventually come into contact with one another as shown in FIG. 9. During this first portion of the flexion range, the compression member 75 bends freely and relatively unconstrained by other structures of the plate 50. Likewise, the tensile member 70, which generally includes a curvature in its resting state, as is generally shown in FIG. 5 for example, tends to begin to straighten somewhat, owing to a small amount of tensile force applied along its longitudinal axis as plate curvature draws the posterior and anterior portions 70*a*, 70*b* of the tensile member 70 outwardly in opposite directions. Throughout such progressively increasing dorsiflexion of the plate 50, the compression member 75 and the tensile member 70 each tend to deviate inwardly toward one another relative to their respective resting, unflexed positions as shown in FIGS. 6-9.

When the bend angle of the plate 50 reaches the predetermined flex angle A1, the compression and tensile members 75, 70 contact one another. Throughout any further dorsiflexion, any further deflection is constrained; neither of the compression member or tensile member is able to move further toward the other. Therefore, as the plate 50 bends further, longitudinally opposing compressive forces directed inwardly upon the compression member 75 can no longer be relieved by the compression member bending outwardly toward the tensile member 70 as they were throughout the first portion of the flexion range. Likewise, longitudinally opposing tensile forces pulling outwardly upon the tensile member 70 can no longer be relieved by the tensile member straightening and drawing inwardly toward the compression member 75 as they were throughout the first portion of the flexion range. Instead, further bending of the plate 50 is additionally constrained by the tensile member's resistance to elongation in response to the progressively increasing tensile forces applied along its longitudinal axis, and by the compression member's resistance to compressive shortening and deformation in response to the compressive forces applied along its longitudinal axis. Accordingly, the tensile and compressive characteristics of the material(s) of the tensile member 70 and compression member 75, respectively, play a large role in determining a change in bend stiffness of the plate 50 as it transitions from the first portion of the flexion range, to and through the second portion of the flexion range. In addition to the mechanical (e.g., tensile, compression, etc.) properties of the selected materials as described above, structure factors likewise affecting changes in bend stiffness during dorsiflexion include but are not limited to the thicknesses, the longitudinal lengths, and the medial-lateral widths of each of the compression member and the tensile member.

The distance "H" is selected to, at least in part, to influence the first predetermined flex angle A1 at which the stiffness enhancing structures and functions described herein will engage. In general, the smaller the distance "H" when the plate 50 is in a resting, unflexed state, the smaller will be the first predetermined flex angle A1. Conversely, the larger the distance "H" when the plate is in a resting, unflexed state, the larger will be the first predetermined flex angle A1. In one exemplary embodiment, the distance "H" is found in the range of between about 1 millimeter and about 15 millimeters. In another exemplary embodiment, the distance "H" is found in the range of between about 4 millimeters and about 10 millimeters. In another embodiment, the distance "H" is found in the range from about 1 millimeter to about 3 millimeters. In another embodiment, the distance "H" is found in the range from about 10 millimeters to about 15 millimeters. These listed ranges are only exemplary, however, and the scope of the embodiments is not intended to be limited by or to only apply to these described ranges. A person having an ordinary level of skill in the relevant art is enabled, in view of this specification and accompanying claims, to adjust such separation to achieve any of a wide range of relationships between a first portion of a flexion range and a second portion of a flexion.

Each of the compression member 60 and the tensile member 70 of the plate 50 can be fashioned from a durable, wear resistant material that is suitably rigid either individually, and/or collectively with the other of the compression member 60 or tensile member 70, to exhibit a bending stiffness of the plate 50, as described herein, during the first portion of the flexion range of the plate 50. Examples of such durable, wear resistant materials include but are not limited to nylon, thermoplastic polyurethane, and carbon fiber. The tensile member 70 can be fashioned from the same material as the compression member 60 so that the bending stiffness exhibited by each of the compression member 60 and the tensile member 70 is substantially the same. Alternatively, the compression member 60 and the tensile member 70 can be fashioned from materials according to their particular individual functions. For example, the compression member 60 will generally be formed of a material that exhibits limited (or no) compression, collapse, or other deformation in response to the levels of compressive forces expected to be applied in response to dorsiflexion during use.

The embodiment(s) depicted in FIGS. 3-9 generally show the plate and stiffness enhancing assembly being integrally formed of unitary construction, stated differently, the plate and stiffness enhancing assembly are formed as a one-piece component, such as by injection molding. Alternatively, either or both of the compression member and the tensile member can be formed separately, and then coupled with the posterior and/or anterior base portions. In an alternative exemplary embodiment shown in FIGS. 10-15, however, the base 160 comprises at least two plies, or layers, 160*a* and 160*b*, extending relatively continuously throughout the length of the plate 150 from the posterior base portion 161 to the anterior base portion 162. The adjacent, facing surfaces of layers 160*a* and 160*b* are bonded to one another generally throughout the posterior and anterior base portions of the plate, 161 and 162 respectively. However, in a forefoot region of the plate generally corresponding positionally to the stiffness enhancing assembly of FIGS. 3-9, the layers are not bonded to one another. Instead, layer 160*a* deviates outwardly away from layer 160*b*, and forms a separation there between when the plate 150 is in a resting, unflexed state. The outwardly deviating portion of layer 160*a* generally forms a tensile member 170 similar to the tensile member 70 of FIGS. 3-9, and similarly includes a posterior portion 170*a*, an anterior portion 170*b*, and a body portion 1 70*c* disposed between the posterior and anterior portions, 170*b* and 170*a* respectively. Similarly, the portion of layer 160*b* aligned with portions 170*a*-170*c* of layer 160*a* forms a compression member 175 similar to the compression member 75 of FIGS. 3-9, and includes each of a posterior portion 175*a*, an anterior portion 175*b*, and a body portion 175*c*. In a manner similar to that described regarding distance "H" of FIGS. 3-9, the separation between the respective body portions 1 70*c* and 1 75*c* has a distance Alternatively, in the posterior base portion 161 of the plate, either or both of layers 160*a* and 1 60*b* may extend rearwardly only partially into the heel region, or fully through the midfoot region but not into the heel region, or only partially through the midfoot region, or fully through the portion of the forefoot region rearward from the stiffness enhancing assembly but not into the midfoot or heel regions. Further, in the posterior base portion 161, either or both of the medial and lateral edges, of either of layers 160*a* and 160*b*, may either follow or depart from the curves and contours of the corresponding medial and lateral edges of the other of layers 160*a* and 160*b*, or of any other portions of the sole structure, if present. Likewise, in the anterior portion 162 of the plate, either or both of layers 160*a* and 160*b* may extend fully to the forward most end of the sole structure in an article of footwear, or either or both of layers 160*a* and 160*b* may instead extend only partially forwardly from the stiffness enhancing assembly, but not entirely to the forward edge of any other portion of the sole structure, if present. Further, in the anterior base portion 162, either or both of the medial and lateral edges, of either of layers 160*a* and 160*b*, may either follow or depart from the curves and contours of the corresponding medial and lateral edges of the other of layers 160*a* and 160*b*, or of any other portions of the sole structure, if present.

Figure 4:
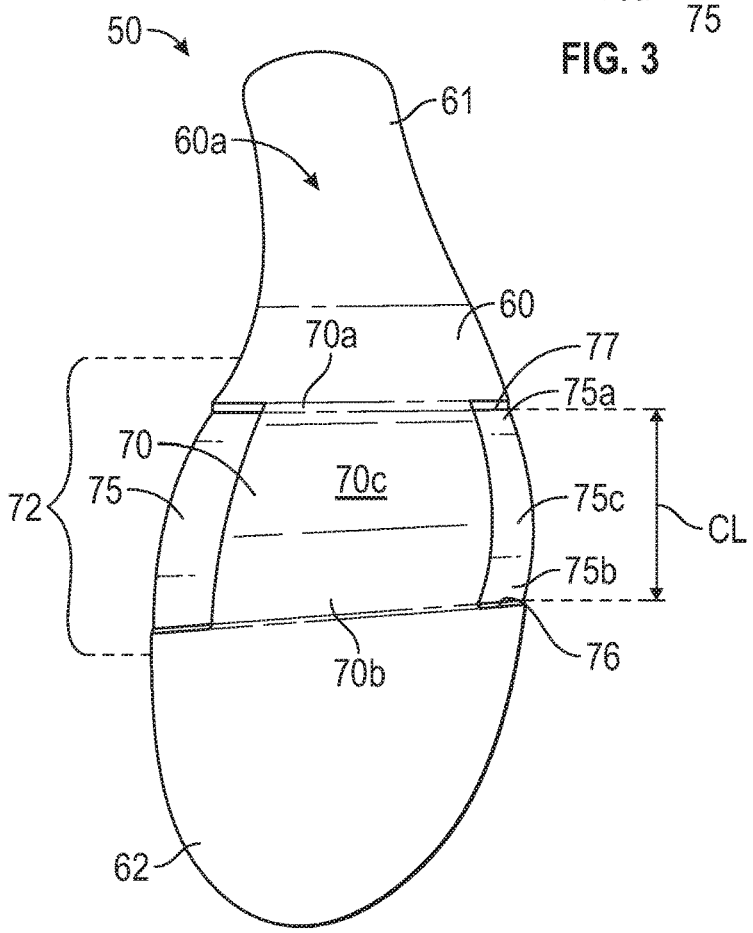
FIG. 4 is a plan view of the ground-facing surface of the sole plate of FIG. 3.

In the embodiment of FIGS. 3-9, the body portion 70*c* of the tensile member 70 is narrower in width (transversely, from the lateral side 12 to the medial side 14 of the plate 50) at one or more of the posterior portion 70*a*, the anterior portion 70*b*, or the body portion 70*c*, than one or more of the corresponding posterior portion 75*a*, anterior portion 75*b*, or the body portion 75*c* of the compression member 75. The width "W" of the tensile member 70 may vary along its anterior-posterior length, as seen in FIG. 4, so that a medial and/or lateral edge of the body portion follows, for example, the curves and contours of the corresponding medial and/or lateral edge of the compression member 75. Alternatively, either or both of the medial and lateral edges of the body portion 70*c* of the tensile member 70 may be straight, and can alternatively be either parallel or non-parallel relative to each other. Similarly, the width of the tensile member 170 of the embodiment of FIGS. 10-15, or any of its posterior, anterior, or body portions, and the medial and/or lateral edges of the tensile member 170, likewise can be configured in any manner as described immediately supra with regard to the embodiments of FIGS. 3-9.

Figure 11:
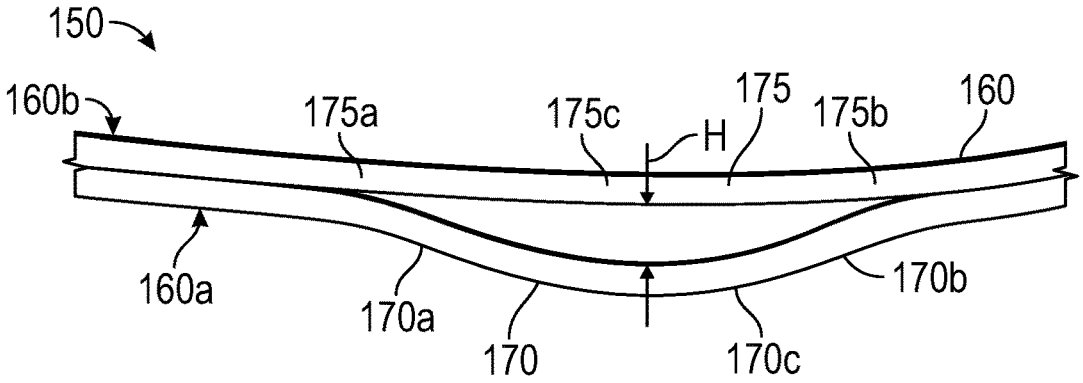
FIG. 11 is a fragmentary side elevation view of a portion of the sole plate of FIG. 10.
Figure 11A:
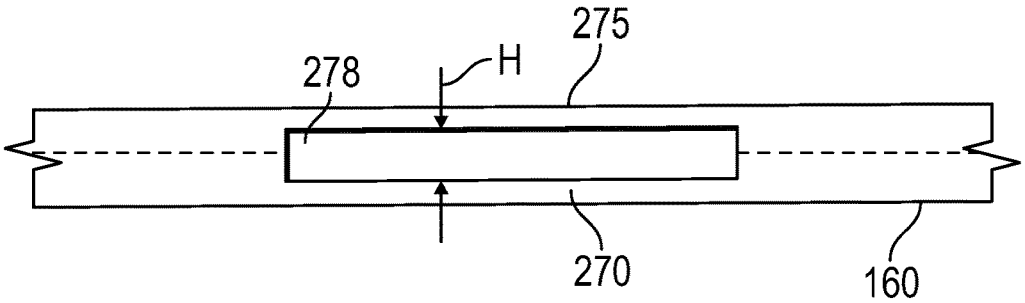
FIG. 11*a* is a fragmentary side elevation view of a portion of a sole plate, according to another exemplary embodiment.
Figure 12:
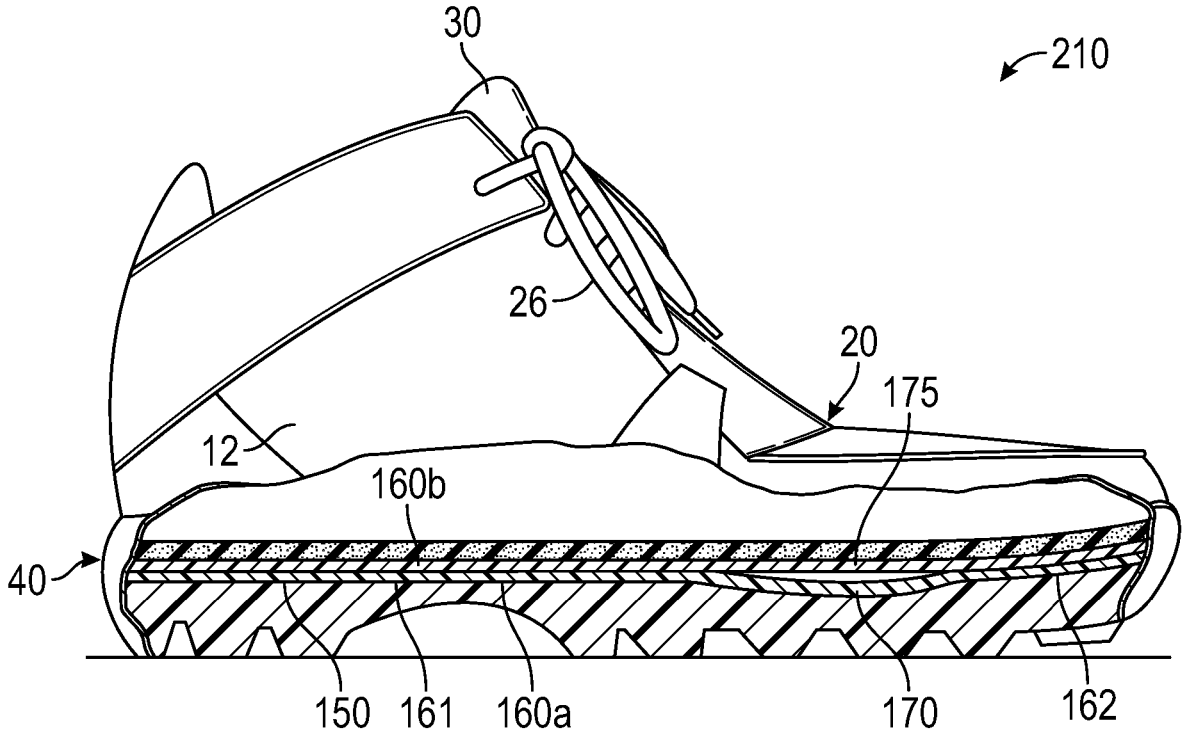
FIG. 12 is a lateral side elevation view of an article of footwear with the sole plate of FIG. 10 in an unflexed, relaxed position, including a partial sectional view of the stiffness enhancing assembly, according to another exemplary embodiment.
Figure 13:
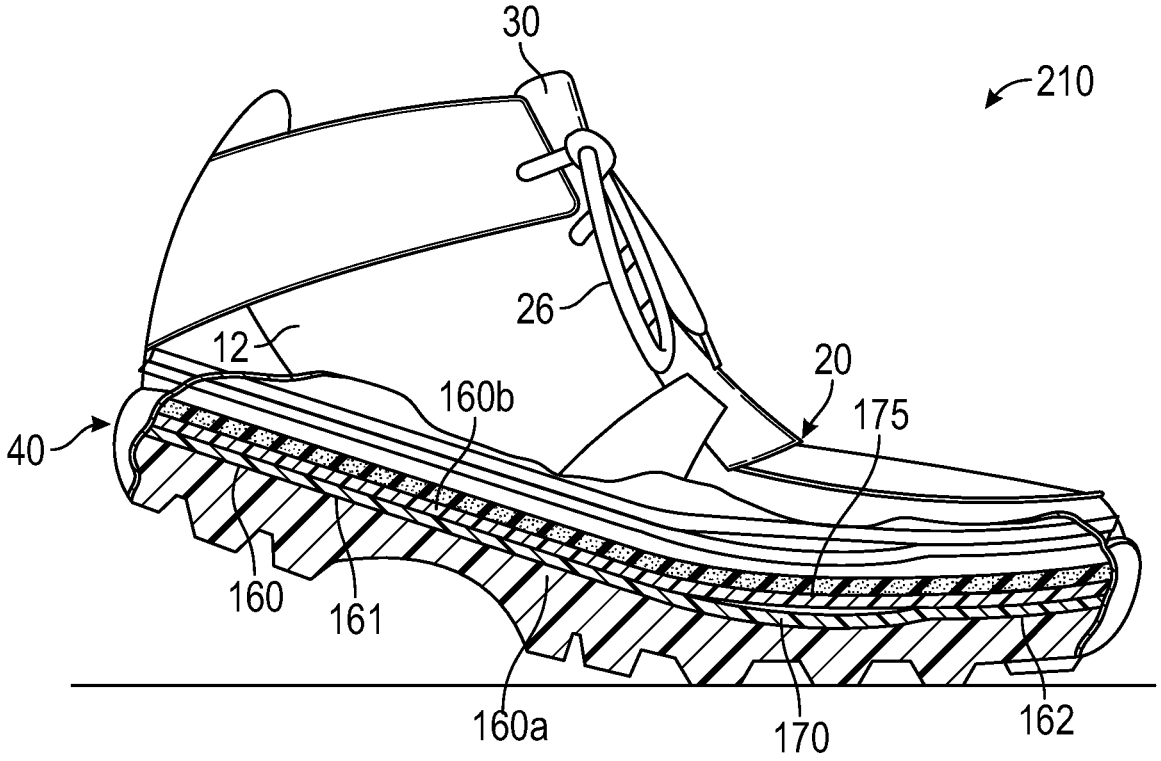
FIG. 13 is a lateral side elevation view of the footwear of FIG. 12 with the sole plate in a partially flexed condition.
Figure 14:
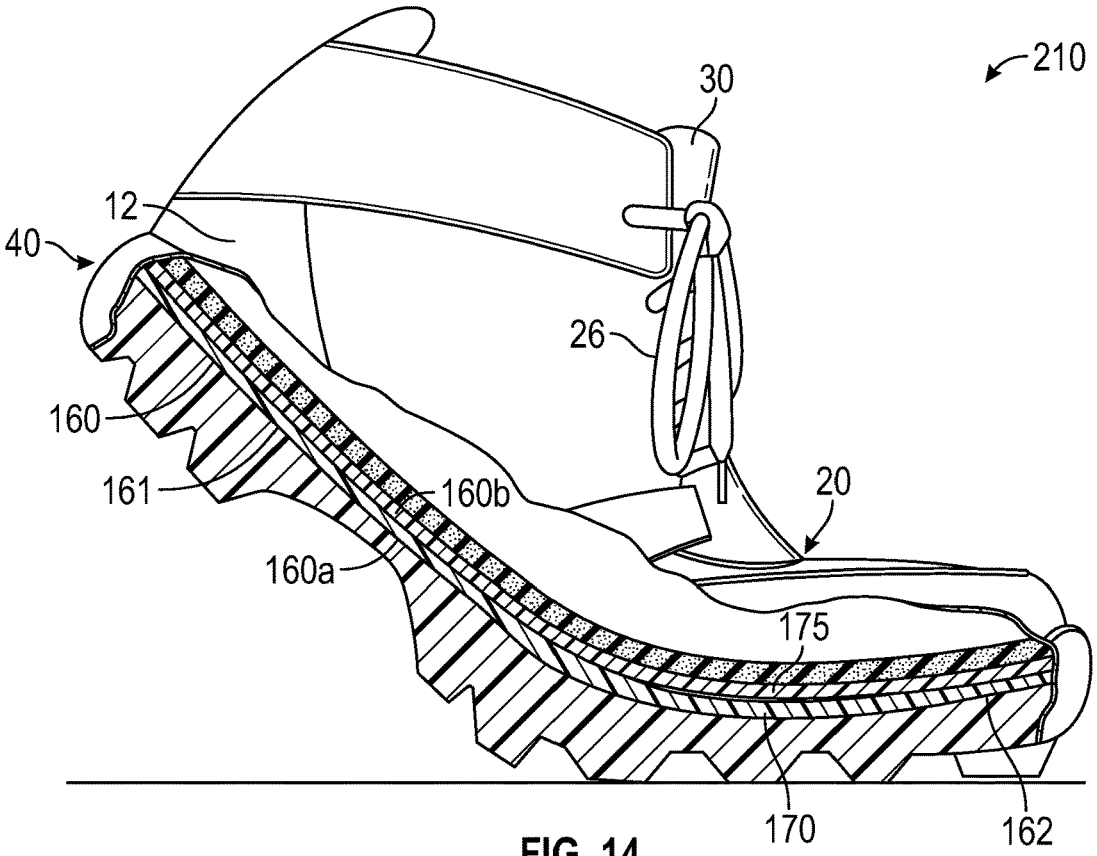
FIG. 14 is a lateral side elevation view of the footwear of FIG. 13 with the sole plate further flexed nearly to an end of a first portion of its flexion range.
Figure 15:
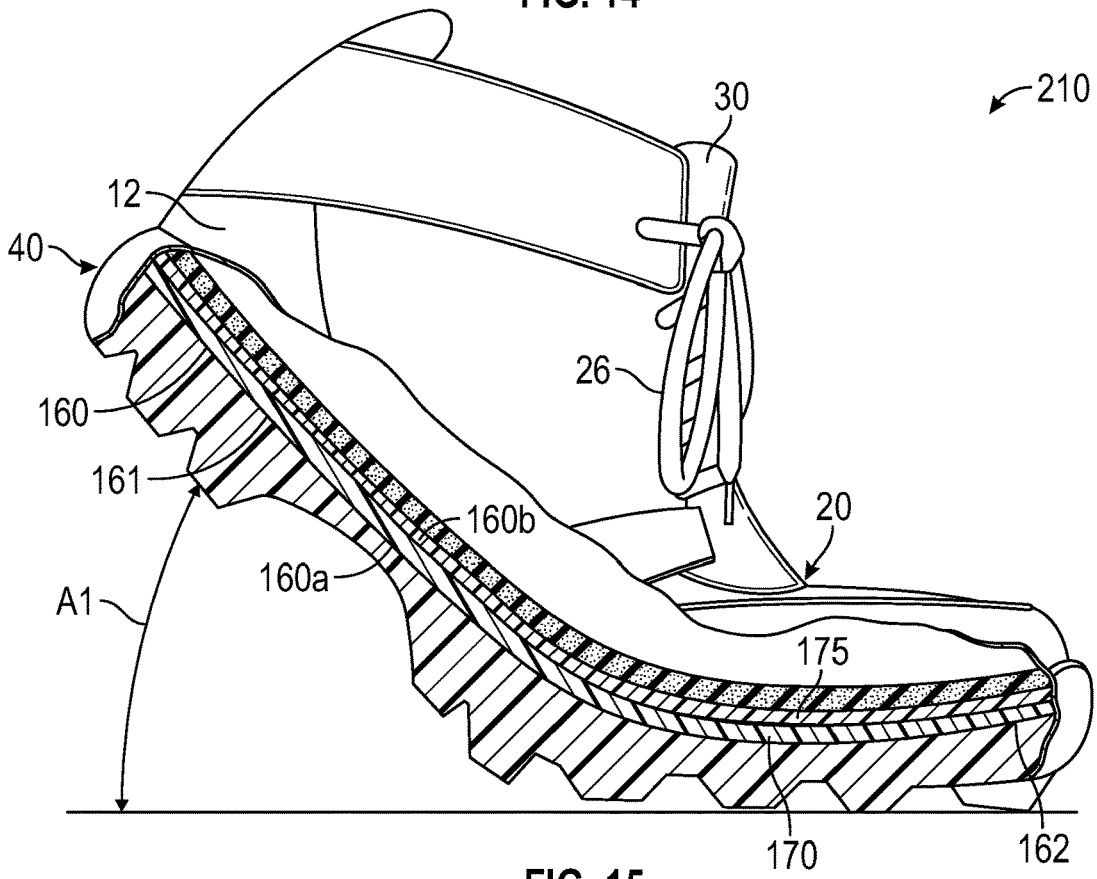
FIG. 15 is a lateral side elevation view of the footwear of FIG. 14, with the sole plate flexed to a first predetermined flex angle.

As seen in the exemplary embodiment of FIG. 5, for example, the tensile member 70 bows outwardly away from the compression member 75. It is noted that in another exemplary embodiment shown in FIG. 11*a*, however, the tensile member 270 may be planar and parallel with the compression member 275, with a hollowed portion 278 extending through the plate from the lateral side to the medial side, between the compression member 275 and the tensile member 270, as seen in FIG. 11*a*.

As described herein, a transition from the first bend stiffness to the second bend stiffness demarcates a boundary between the first portion of the flexion range and the second portion of the flexion range. As the materials and structures of the embodiment proceed through a range of increasing flexion, they may tend to increasingly resist further flexion. Therefore, a person having an ordinary level of skill in the relevant art will recognize in view of this specification and accompanying claims, that a bend stiffness of the sole throughout the first flexion range may not remain constant. Nonetheless, such resistance will generally increase linearly or smoothly and progressively through a range of increasing dorsiflexion. By contrast, the embodiments disclosed herein provide for a stepwise increase in resistance to flexion at the boundary between the first portion of the flexion range and the second portion of the flexion range that departs from the smooth and progressive increase throughout the first portion of the flexion range.

It will be understood that various modifications can be made to the embodiments of the present disclosure without departing from the spirit and scope thereof. Therefore, the above description should not be construed as limiting the disclosure, but merely as embodiments thereof. Those skilled in the art will envision other modifications within the scope and spirit of the invention as defined by the claims appended hereto. For example, the configurations of the stiffness enhancing assemblies and members contemplated by the present disclosure that may be configured as various different structures without departing from the scope of the present disclosure. Further, the types of materials used to provide the enhanced stiffness may include those described herein and others that provide the described stiffness enhancing function without departing from the scope of the present disclosure. While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting.

The invention claimed is:

1. A sole structure for an article of footwear comprising:

a sole plate having a forefoot region, wherein the sole plate has a first side and a second side opposite the first side; and a stiffness enhancing assembly disposed in the forefoot region of the sole plate, the stiffness enhancing assembly comprising:

a compression member disposed at the first side of the sole plate, wherein the compression member has a compression-member length;

a tensile member disposed at the second side of the sole plate from the compression member; wherein the tensile member has a tensile-member length;

wherein the tensile member is spaced apart from the compression member by a gap when the sole structure is in an unflexed position;

wherein the tensile member contacts the compression member when the sole structure is dorsiflexed to or beyond a first predetermined flex angle;

wherein the tensile member and the compression member have a uniform thickness along a respective one of the tensile-member length and the compression-member length; and wherein the sole structure has a first bending stiffness when the tensile member is spaced apart from the compression member and a second bending stiffness when the tensile member contacts the compression member, and the second bending stiffness is greater than the first bending stiffness.

2. The sole structure of claim 1, wherein the tensile member has a tensile-member anterior extent, a tensile-member posterior extent opposite the tensile-member anterior extent, and the tensile-member length extends from the tensile-member anterior extent to the tensile-member posterior extent.

3. The sole structure of claim 2, wherein the compression member has a compression-member anterior extent, a compression-member posterior extent opposite the compression-member posterior extent, and the compression-member length extends from the compression-member anterior extent to the compression-member posterior extent.

4. The sole structure of claim 1, wherein the tensile member is spaced apart from the compression member by a first distance when the sole structure is in the unflexed position, and the first distance progressively decreases as the sole structure is dorsiflexed until the tensile member contacts the compression member.

5. The sole structure of claim 4, wherein:

the tensile member includes a posterior portion, an anterior portion, and a body portion disposed between the posterior portion and the body portion; and the tensile member is spaced apart from the body portion of the compression member by the first distance when the sole structure is in the unflexed position.

6. The sole structure of claim 5, wherein the body portion of the tensile member remains spaced apart from the compression member when the sole structure is in the unflexed position, and wherein the body portion of the tensile member is in contact with the compression member when the sole structure is dorsiflexed to or beyond the first predetermined flex angle.

7. The sole structure of claim 6, wherein a width of the body portion of the tensile member is less than a width of the compression member.

8. The sole structure of claim 1, further comprising an outsole, wherein the sole plate is disposed on the outsole.

9. The sole structure of claim 8, wherein the outsole further comprises a plurality of cleats extending from a ground-facing surface of the outsole.

10. The sole structure of claim 1, wherein either or both of the compression member and the tensile member are comprised either of nylon or thermoplastic polyurethane.

11. The sole structure of claim 1, wherein the sole plate and the stiffness enhancing assembly are integrally formed of unitary construction.

12. The sole structure of claim 1, wherein the tensile member bows outwardly away from the compression member when the sole plate is in a relaxed, unflexed state.

13. The sole structure of claim 1, wherein the tensile member is planar and parallel with the compression member when the sole plate is in a relaxed, unflexed state.

14. The sole structure of claim 1, wherein the uniform thickness of the tensile member is the same as the uniform thickness of the compression member.

15. A sole structure for an article of footwear comprising:

a sole plate having a forefoot region, wherein the sole plate has a first side and a second side opposite the first side; and a stiffness enhancing assembly disposed in the forefoot region of the sole plate, the stiffness enhancing assembly comprising:

a compression member disposed at the first side of the sole plate, wherein the compression member has a compression-member length; and a bowed tensile member disposed at the second side of the sole plate from the compression member and having an anterior portion, a body portion, and a posterior portion arranged longitudinally and descending below the compression member such that the body portion is spaced apart from the compression member by a gap when the sole structure is in an unflexed, relaxed state, wherein the tensile member has a tensile-member length;

wherein dorsiflexion of the sole structure causes the compression member and the tensile member to progressively close the gap;

wherein the tensile member and the compression member have a uniform thickness along a respective one of the tensile-member length and the compression-member length; and wherein the tensile member is spaced apart from the compression member by a first distance when the sole structure is in an unflexed position, and the first distance progressively decreases as the sole structure is dorsiflexed until the tensile member contacts the compression member.

16. The sole structure of claim 15, wherein the sole plate incudes a base having a posterior base portion and an anterior base portion, the stiffness enhancing assembly is disposed between the posterior base portion and the anterior base portion, the posterior base portion extends from a heel region of the sole plate to a midfoot region of the sole plate, the anterior base portion extends within the forefoot region of the sole plate, each of the compression member and the tensile member is directly coupled to the anterior base portion, each of the compression member and the tensile member is directly coupled to the posterior base portion.

17. The sole structure of claim 15, wherein the sole plate and the stiffness enhancing assembly are integrally formed of unitary construction.

18. The sole structure of claim 15, wherein the uniform thickness of the tensile member is the same as the uniform thickness of the compression member.

19. The sole structure of claim 15, wherein dorsiflexion of the sole structure causes the compression member and the tensile member to progressively close the gap as the sole structure flexes through a first portion of a flexion range until the compression member and the tensile member contact one another when the sole structure is dorsiflexed at a first predetermined flex angle, such that a change in bending stiffness of the sole structure begins at the first predetermined flex angle.

20. The sole structure of claim 15, wherein the sole plate incudes a base having a posterior base portion and an anterior base portion, the stiffness enhancing assembly is disposed between the posterior base portion and the anterior base portion, the posterior base portion extends from a heel region of the sole plate to a midfoot region of the sole plate, the anterior base portion extends within the forefoot region of the sole plate, the sole plate comprises a first layer and a second layer; the first layer includes the compression member, the second layer incudes the tensile member, and the first layer and the second layer are bonded to one another along the posterior base portion and the anterior base portion.

* * * * *